US006422579B1

(12) United States Patent
Lindblad

(10) Patent No.: US 6,422,579 B1
(45) Date of Patent: Jul. 23, 2002

(54) ADJUSTABLE SIZE SKATE DESIGN

(75) Inventor: Shaun C. Lindblad, Lino Lakes, MN (US)

(73) Assignee: First Team Sports, Inc., Anoka, MN (US)

( * ) Notice: Subject to any disclaimer, the term of this patent is extended or adjusted under 35 U.S.C. 154(b) by 0 days.

(21) Appl. No.: 09/493,164

(22) Filed: Jan. 27, 2000

(51) Int. Cl.[7] ..... A63C 17/00
(52) U.S. Cl. ..... 280/11.26; 280/11.27
(58) Field of Search ..... 280/11.231, 11.223, 280/11.15, 11.16, 11.27, 11.26

(56) References Cited

U.S. PATENT DOCUMENTS

| | | | | | |
|---|---|---|---|---|---|
| 1,071,721 | A | * | 9/1913 | Finlay | 280/11.26 |
| RE32,346 | E | | 2/1987 | Klamer et al. | 280/11.2 |
| 5,295,701 | A | | 3/1994 | Reiber et al. | 280/11.22 |
| 5,408,763 | A | | 4/1995 | Sartor et al. | 36/115 |
| 5,452,907 | A | | 9/1995 | Meibock et al. | 280/11.22 |
| 5,459,949 | A | | 10/1995 | MacPhail | 36/117 |
| 5,475,936 | A | | 12/1995 | Cavasin | 36/115 |
| 5,484,149 | A | | 1/1996 | Lee | 280/11.26 |
| 5,620,190 | A | | 4/1997 | Maggiore | 280/11.21 |
| 5,645,288 | A | | 7/1997 | Lu | 280/11.26 |
| 5,678,833 | A | | 10/1997 | Olson et al. | 280/11.22 |
| 5,741,018 | A | | 4/1998 | Huang | 280/11.3 |
| 5,842,293 | A | * | 12/1998 | Young | 280/11.231 |
| 5,904,359 | A | * | 5/1999 | Caeran et al. | 280/11.15 |
| 6,050,574 | A | | 4/2000 | Olson et al. | 280/11.22 |

FOREIGN PATENT DOCUMENTS

| | | | | |
|---|---|---|---|---|
| FR | 716228 | * | 12/1931 | 280/11.223 |

OTHER PUBLICATIONS

"KIDS", *Ultra Wheels Kids 1999*, pp. 1–2, published Jun. 1998.
"Design Fax Message", pp. 1–4, Sep. 9, 1998, fax from Oreste Favaro to Rick Jackson.
"Adjustable Sole Support", p. 1, Jan. 28, 1999, fax to Rick Jackson from Chace–Glow Co., Ltd.

* cited by examiner

*Primary Examiner*—Douglas Hess
*Assistant Examiner*—Elaine Gort
(74) *Attorney, Agent, or Firm*—Drinker Biddle & Reath LLP

(57) ABSTRACT

The invention includes a skate comprising a toe box portion, a front frame portion, a heel portion, and a rear frame portion. The front frame portion is preferably integrally connected to the toe box portion which includes an instep side and an outer side. The front frame portion is adapted to hold at least one ground engaging wheel. The rear frame portion is integrally connected to the heel portion and includes an instep side and an outer side. The rear frame portion is adapted to hold at least one ground engaging wheel. The rear frame portion includes a first forwardly extending arm that slideably engages the front frame portion. The front frame portion includes a first rearwardly extending arm that slideably engages the rear frame portion. The toe box portion and the heel portion are slidable towards or away from each other to adjust the length of the skate.

17 Claims, 9 Drawing Sheets

ADJUSTABLE SIZE SKATE DESIGN

BACKGROUND OF THE INVENTION

The present invention relates to in-line skates, and in particular to in-line skates wherein the boot size is adjustable to accommodate different sizes.

In-line skating is currently enjoying a tremendous popularity. In addition to be enjoyable exercise for adults, children have increasingly begun to participate in in-line skating.

In order to provide a one size fits all in-line skate for adults, as well as a skate which will accommodate a foot of a growing child, expanding skates have been developed. This type of in-line skate eliminates the need to re-purchase skates for a child's growing foot, or the struggle to find a skate which fits a variety of adult foot sizes.

In the past, this expansion capability was accomplished by adjusting the boot portion of the skate. Specifically, the boot was adjusted by sliding the toe portion of the skate with respect to the heel portion of the skate and having an oversized liner which would expand or contract to adjust to the boot size selected.

This expansion style, however, did not adjust the wheel frame portion of the skate. Instead, the wheel spacing was the same regardless of the adjustment to the boot portion. Thus, when the boot portion of the skate was expanded, the boot length increased with respect to the wheel base length. Therefore, for a longer boot accommodating a larger foot, less support was provided by the wheel base.

On the other hand, when the boot portion was contracted to accommodate a smaller foot, the boot length decreased with respect to the wheel base length. Thus, when a smaller boot was needed to accommodate a smaller person, the wheel base was oversized and unwieldy. Prior expansion skates traded performance for expansion capability.

Other art exists where the skate support may be expanded by sliding a single wheel on the wheel base away from the remaining wheels. This type of skate design is problematic for performance issues. Skates which expand along the boot, but expand the wheel base disproportionately to the expansion of the boot result in an improperly balanced skate. Expanding the boot size disproportionately from the wheel base again results in inadequate support for the foot. Low performance by the skate results as well as an increase in the possibility for injury to the wearer.

Additionally, the prior art utilizes tracks mounted under the sole of the foot to provide for expansion of the wheel. This style of design can be problematic when designing boots to conform to a foot since the addition of a track defines the sole of the boot. Adjustment can also be difficult, since the expansion means are under the wearer's foot, limiting accessibility.

BRIEF SUMMARY OF THE INVENTION

The preferred embodiment of the present invention includes an adjustable fit in-line skate that utilizes an expansion configuration which expands the wheel base proportionately to the boot when the boot size is expanded and decreases the wheel base proportionately to the boot when the boot size is decreased.

DETAILED DESCRIPTION

Figure 1:
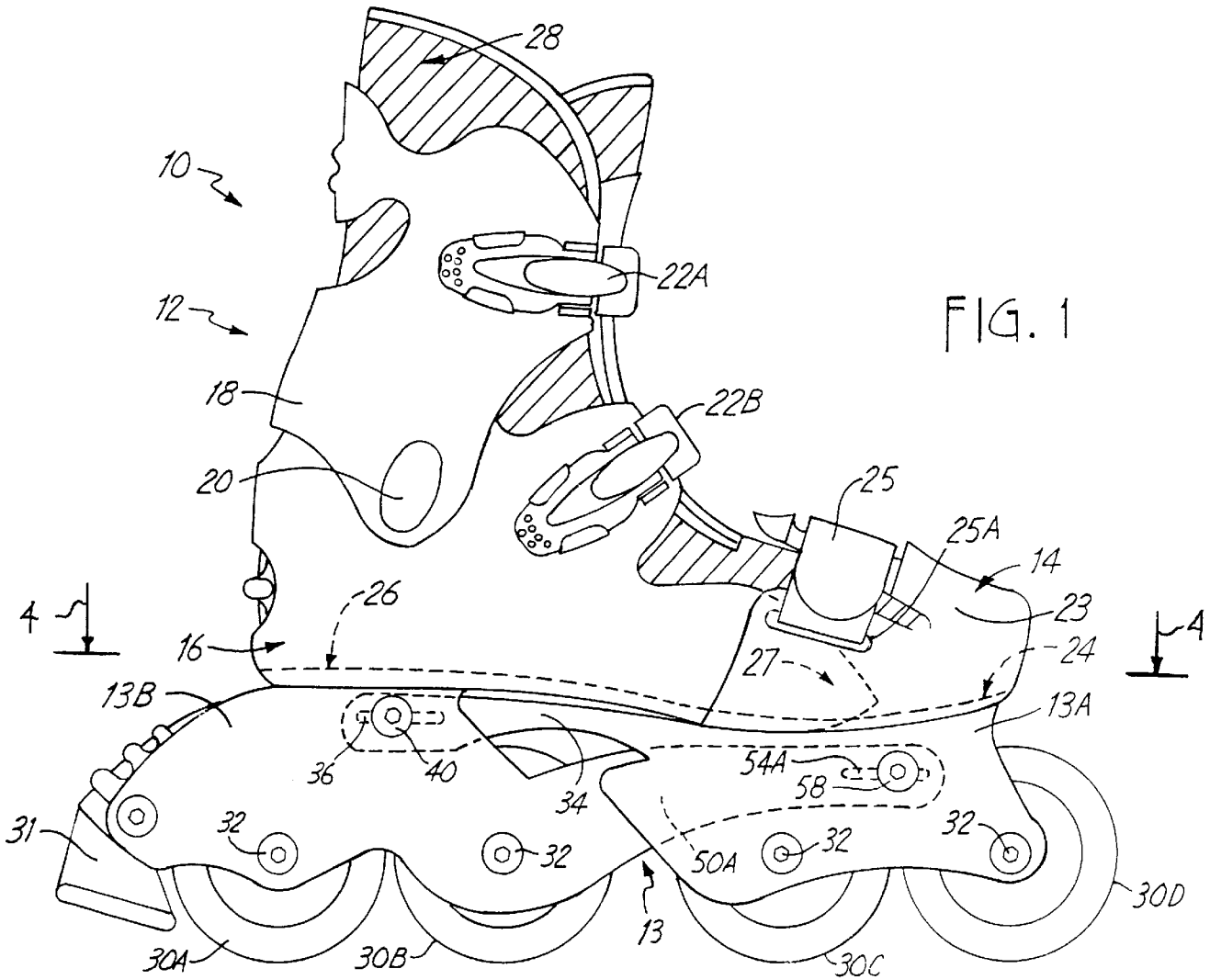
FIG. 1 is a side view of the inventive in-line skate.

The skate of the present invention is illustrated generally in FIG. 1 at 10. The skate 10 includes a boot frame 12 and a wheel holder frame 13. The size of the boot frame 12 may be modified in length. The boot frame 12 includes a toe box 14 and a heel portion 16. A cuff portion 18 is pivotally mounted to the heel portion 16 in a conventional manner by a pair of pivots 20, each pivot 20 being located on opposing sides of the cuff portion 18. A person skilled in the art will realize that other methods of securing the cuff portion 18 to the heel portion 16 may be used, including molding the cuff portion 18 to the heel portion 16 into one integrated piece. Conventional style buckles 22A and 22B are secured to the cuff portion 18 and the heel portion 16, respectively so that the boot frame 12 may be securely fastened to the leg and foot of a wearer.

The toe box 14 includes a toe cap portion 23 and a toe sole portion 24. A toe strap 25 (or alternatively a buckle) secures a portion of the toe box 14 of the boot frame 12 to the foot. The strap 25 is of the type commonly known in the art and extends through strap apertures 25A in the toe cap 23.

The heel portion 16 includes a heel sole portion 26. The heel sole portion 26 extends forwardly approximately to the instep of the foot. Flexible left and right vamp sections 27 extend forwardly past the heel sole portion 26 and into the toe cap 23 of the toe box 14. It will be appreciated that the toe sole portion 24 and the heel sole portion 26 cooperate to form a support for the wearer's foot.

A suitable liner 28 is disposed inside the boot frame 12. Liner 28 has an elastic section proximate the toe box 14 so that the liner 28 can accommodate different foot sizes. Such liners are known in the art.

The wheel holder frame 13 includes a front frame portion 13A and a rear frame portion 13B. The toe box 14 is integrally connected to the front frame 13A, and the heel portion 16 is integrally connected to the rear frame 13B. Since the skate 10 is preferably constructed of plastic, the connection between the components is typically accomplished by molding the connected portions of the skate as one piece. A person skilled in the art will realize that the components may be fixed together using other methods (riveting, gluing, and the like) as is known in the art. Both the front frame 13A and the rear frame 13B retain a plurality of freewheeling roller skate wheels 30A–30D. The wheels 30A–30D are rotatably secured to the wheel holder frame 13 by suitable fasteners 32 that are known in the art. Additionally, a brake 31 is fixedly mounted to the rear frame portion 13, as is known in the art.

The skate 10 of the present invention is modifiable in length, allowing the wearer to customize the skate 10 to fit his or her foot. This is particularly advantageous for use by youth whose foot size may change significantly in a short period of time. The length of the skate 10 of the present invention is modified by moving the toe box portion 14 of the boot frame 12 in relation to the heel portion 16 of the boot frame 12. Since the heel portion 16 of the boot frame 12 is integrally connected to the rear frame portion 13B of the wheel holder frame 13, moving the heel portion 16 moves the rear frame portion 13B of the wheel holder frame 13. Similarly, since the toe box portion 14 of the boot frame 12 is integrally connected to the front frame portion 13A, moving the toe box 14 moves the front portion 13A of the wheel holder frame 13. When the heel portion 16 of the boot frame 12 is moved towards the toe box portion 14, the boot is made smaller (decreasing the boot size). The vamp sections 27 are forced by the toe box 14 towards the center of the boot, thereby adjusting the width (smaller) of the forward section of the boot 12, as well as the length. Alternatively, moving the toe box 14 away from the heel portion 16 makes the boot 12 larger (increasing the boot size). The vamp sections 27 flex outwardly, once again adjusting the width (larger) of the forward section of the boot 12.

A toe box arm 34, best illustrated in HG. 2, projects rearwardly from the front frame 13A. The toe box arm 34 extends transversely from an instep side 33A to an outer side 33B of the skate 10. A distal end 35 of the toe box arm 34 includes a rear slot 36 through the toe box arm 34. The slot 36 preferably extends longitudinally along the arm 34. Opposing rear apertures 38A and 38B are disposed through the instep side 33A and the outer side 33B of the rear frame 13B. The slot 36 in the toe box arm 34 is disposed proximate to the rear apertures 38A and 38B. The toe box arm 34 is fixably secured to the rear frame 13B using a rear locking nut 40 and a rear locking screw 42. The locking nut 40 extends through the rear aperture 38A and the rear slot 36 from the instep side 33A the of skate 10. The locking screw 42 extends through the rear aperture 38B and the rear slot 36 from the outer side 33B of skate 10 and engages the locking nut 40. Alternatively, the locking screw and nut may be inserted from the opposite side of that described.

In a first embodiment of the invention, tightening the locking nut 40 and the locking screw 42 causes frictional interference between the toe box arm 34 and the rear frame 13B which fixably disposes the toe box arm 34 in place with respect to the rear frame 13B. Loosening the locking screw 42 from the locking nut 40 (while still maintaining a level of engagement) allows the toe box arm 34 to be adjusted in position with respect to the rear frame portion 13B. The toe box arm 34 is adjustable in position so that the slot 36 can be disposed along its length at alternate positions with respect to the apertures 38A and 38B. The nut 40 can be re-tightened, securing the toe box arm 34 in place by increasing the frictional interference between the toe box arm 34 and the rear frame 13B.

Figure 3:
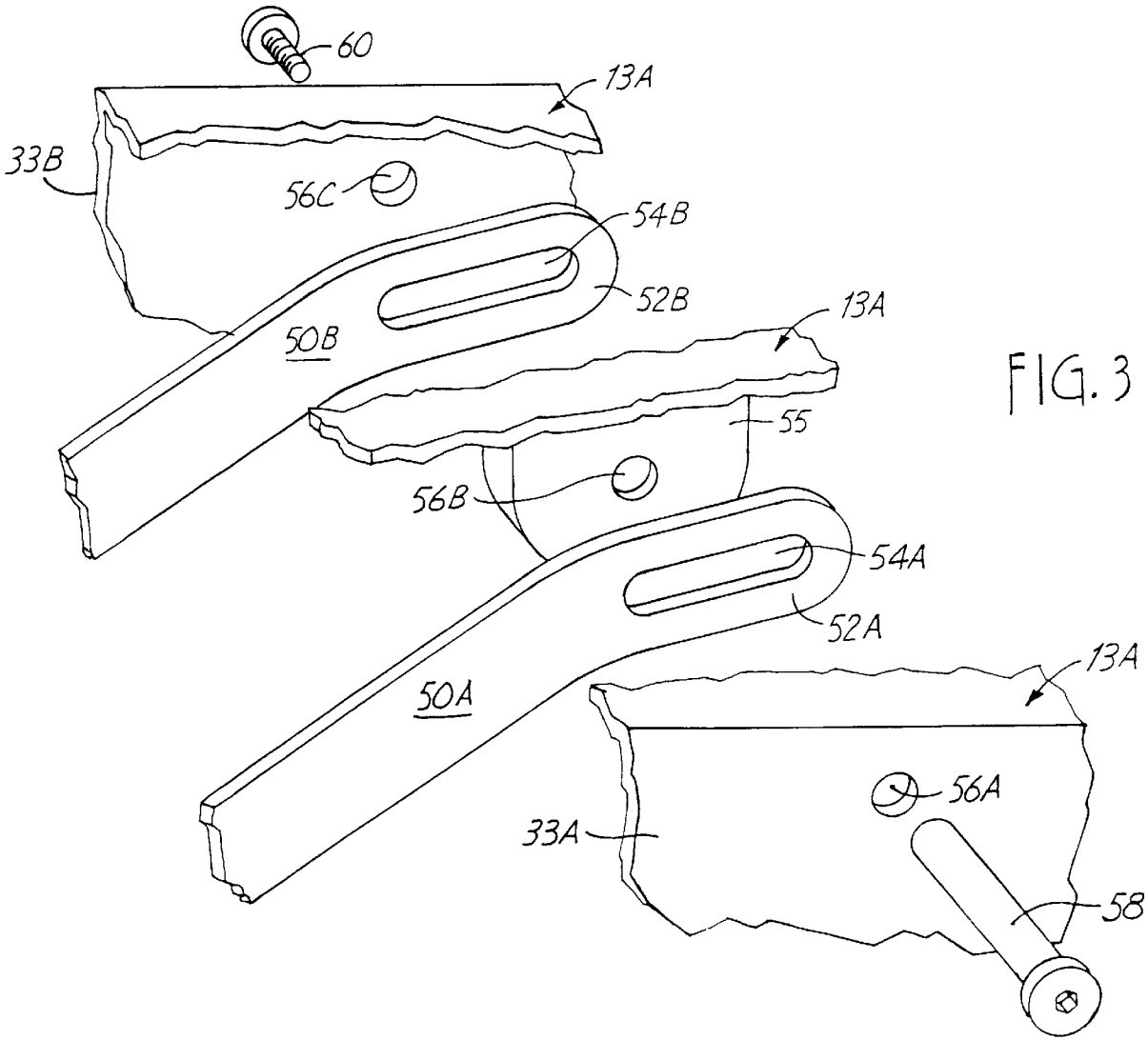
FIG. 3 is a partial exploded perspective view of the front frame showing the expansion mechanism.

A pair of heel arms 50A and 50B, best illustrated in FIG. 3, extend forwardly from the rear frame 13B. A distal end of each heel arm 52A and 52B includes front slots 54A and 54B extending through the heel arms 50A and 50B, respectively. The slots 54A and 54B preferably extend longitudinally along the arms 50A and 50B. A downward extending middle frame member 55 is disposed between the heel arms 50A and 50B. The frame member 55 is integrally connected to the front frame portion 13A. Front apertures 56A, 56B and 56C are disposed through the front frame portion 13A. The front apertures 56A–56C are aligned transversely across the front frame portion 13A. The first aperture 56A extends through the instep side 33A of the front frame 13A, the second aperture 56B extends through the frame member 55 and the third aperture 56C extends through the outer side 33B of the front frame 13A.

The first heel arm 50A is disposed between the instep side 33A and the middle frame member 55 of the front frame 13A. The second heel arm 50B is disposed between the middle frame member 55 and the outer side 33B of the front frame 13A. The slots 54A and 54B in each heel arm 50A and 50B are disposed proximate to the front apertures 56A–56C extending through the instep side 33A, the middle frame member 55 and the outer sides 33B, of the front frame portion 13A. The heel arms 50A and 50B are fixably secured to the front frame 13A using a front locking nut 58 and a front locking screw 60. The locking nut 58 extends through the first aperture 56A from the instep side 33A of the skate 10, and then through the front slot 54A and second aperture 56B in the middle member 55. The locking screw 60 extends through the aperture 56C from the outer side 33B of the skate 10, through the front slot 54B and into the second aperture 56B in the middle member 55 where it engages the locking nut 58. Alternatively, the locking screw and nut may be inserted from the opposite side of that described.

Tightening the locking nut 58 and the locking screw 60 increases the frictional interference between the heel arms 50A and 50B and the front frame 13A which fixably disposes the apertures 56A–56C under the front rear slots 54A and 54B of the heel arms 52A and 52B. Loosening the locking screw 60 from the locking nut 58 allows the heel arms 50A and 50B to be adjusted in position with respect to the front frame portion 13A. The heel arms 50A and 50B are adjustable in position so that the apertures 56A–56C are disposed at an alternate position along the length of the front slots 54A and 54B. The nut 58 can be re-tightened, securing the heel arms 50A and 50B in place by increasing the frictional interference between the heel arms 50A and 50B and the front frame 13A.

A person skilled in the art will realize that although the preferred embodiment of the invention shows one rearwardly extending toe box arm 34 and two forwardly extending heel arms 50A and 50B, other embodiments exist utilizing other arm configurations (using any number of forwardly and rearwardly extending arms) which would not depart from the spirit and scope of the invention. For example, one alternate embodiment would utilize two rearwardly projecting arms and one forwardly projecting arm, reversing the configuration of the preferred embodiment. Alternatively, two or three (or more) rearwardly and two or three (or more) forwardly projecting arms may extend from the front and rear frame, respectively. Another example of an alternate configuration would be one rearwardly and one forwardly projecting arm extending from the front and rear frame, respectively.

Figure 4:
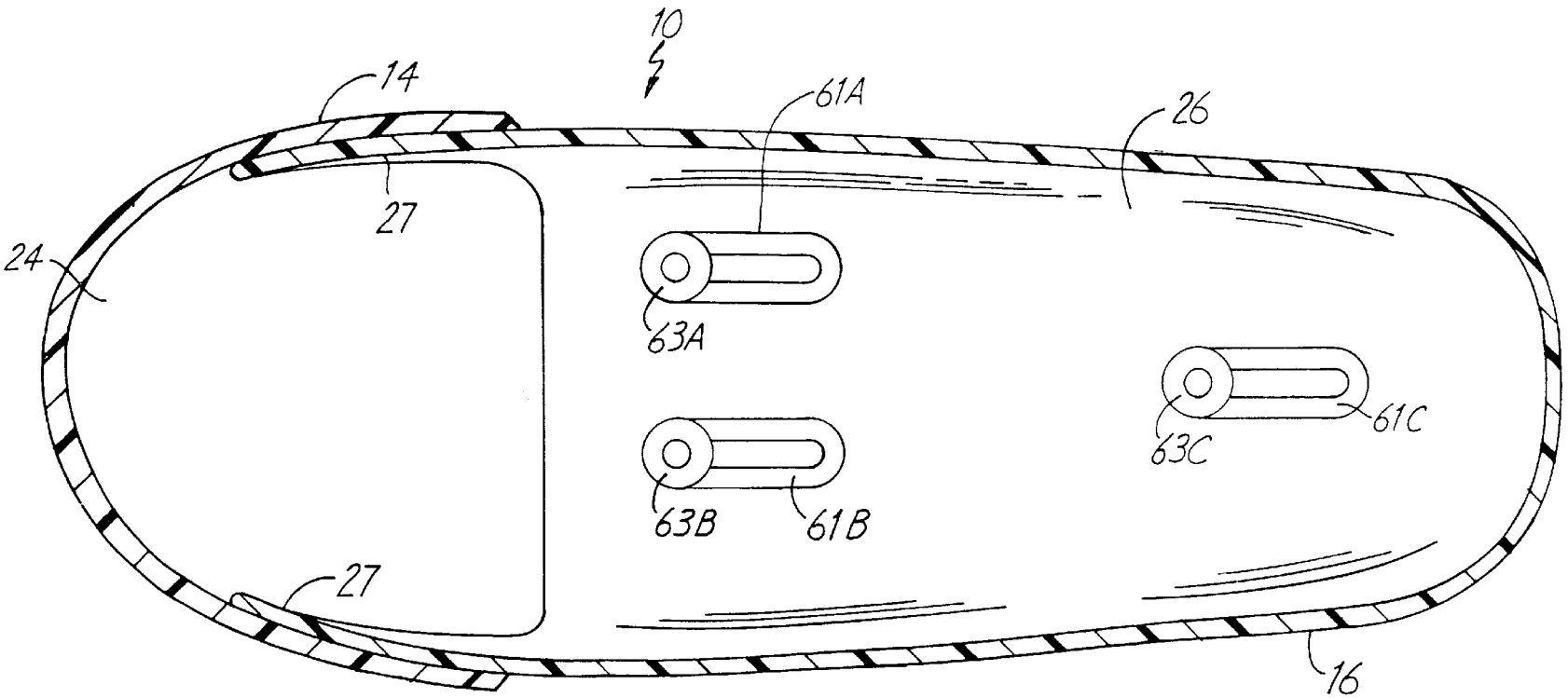
FIG. 4 is a sectional view taken along the line 4—4 in FIG. 1.

The skate 10 may additionally utilize retention slots 61A, 61B and 61C and rivets 63A, 63B and 63C to allow for further securement of the heel portion 16 to the front frame portion 13A, as illustrated in FIG. 4. The retention slots 61A–61C are disposed through the heel sole portion 26 longitudinally along the skate 10. The retention slots 61A–61C are the same length as the rear slot 36 disposed through the toe box arm 34 and the front slots 54A and 54B disposed through the heel arms 50A and 50B. The rivets 63A–63C extend through the retention slots 61A–61C into the toe box arm 34. If the locking nuts 40 and 58 and the locking screws 42 and 60 are removed by the user, the retention slots 61A–61C and retention rivets 63A–63C prevent the toe box 14 from being completely removed from the heel portion 16. The retention slots 61A–61C and the retention rivets 63A–63C also serve to add further safety factors to the skate, reducing the likelihood of injury to the user. An insert (not shown) may be placed over the heel sole portion 26 and toe sole portion 24 to prevent the rivets 63A–63C from interfering with the liner 28.

Adjusting the skate 10 in the manner described above allows the skate 10 to accommodate a variety of foot sizes while still providing exceptional support for the foot. Support is provided because when the boot frame 12 is adjusted in size, the wheel holder frame 13 is adjusted proportionately to the expansion of the boot frame 12, as illustrated in FIG. 4A–4D.

Figure 4B:
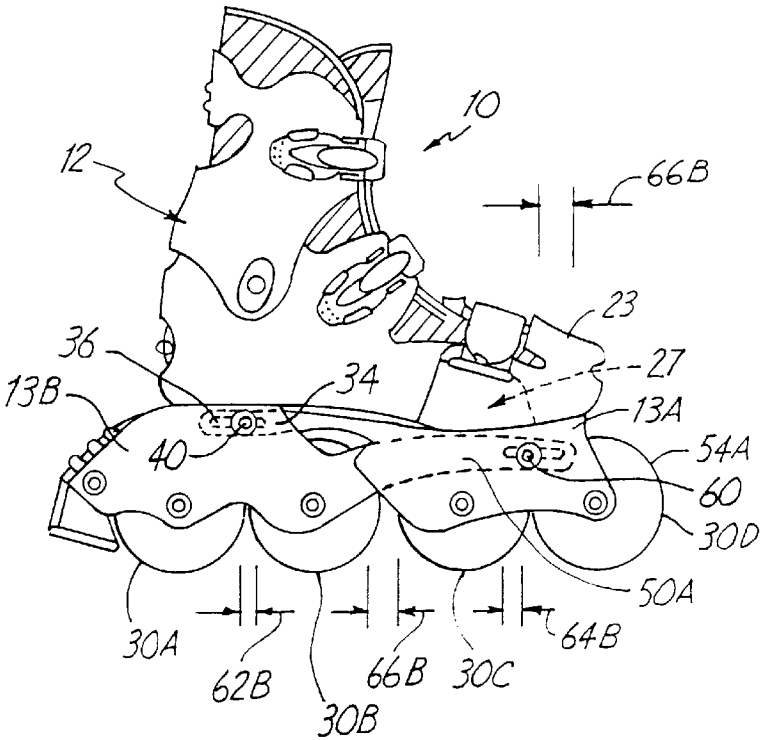
FIG. 4A–FIG. 4D each are a side view of the inventive in-line skate adjusted to a different size.
Figure 4A:
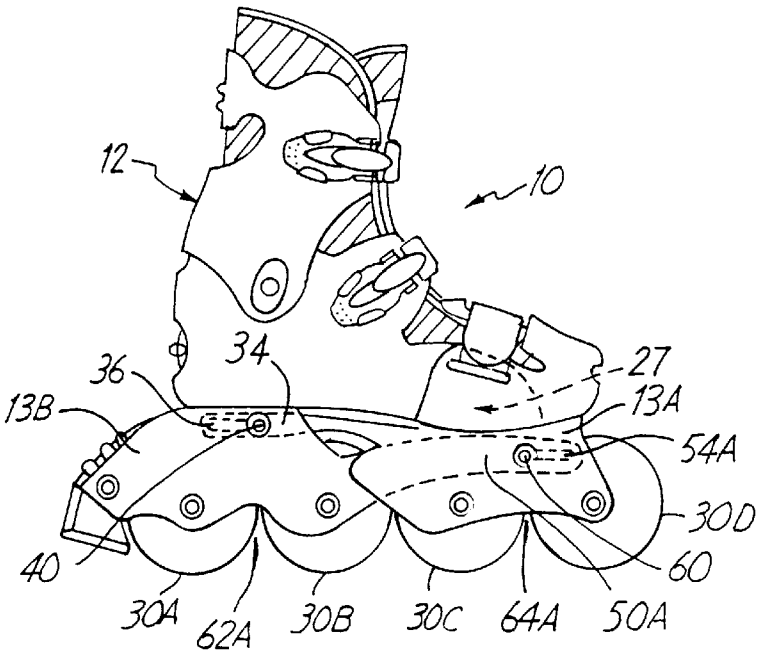

FIG. 4A (in conjunction with FIGS. 2 and 3) best illustrate the skate 10 in its extreme contracted (or "smallest") setting. In other words, the skate 10 is set so that it can be adjusted to accommodate a larger foot, however, it cannot be adjusted to accommodate a smaller foot. To set the skate 10 to this size, the toe box arm 34 is disposed in the most rearward position with respect to the rear frame portion 13B. The rearward distance is defined by the rear locking nut and screw 40 and 42 interfacing with the rear slot 36. The rear locking nut 40 and rear locking screw 42 are disposed through the proximate end of the rear slot 36 (so that the rear nut and screw 40 and 42 prevent the skate 10 from being further contracted). The nut 40 and screw 42 extend though rear apertures 38A and 38B where they are mated. The nut 40 and screw 42 are tightened so as to prevent movement of the toe box arm 34 with respect to the rear frame portion 13B. Tightening the nut and screw 40 and 42 locks the rear apertures 38A and 38B, at a longitudinal position 62A along the toe box arm 34.

The heel arms 50A and 50B are disposed in the most forward position with respect to the front frame portion 13A so that the front locking nut and screw 58 and 60 prevent the skate 10 from being further contracted. The front locking nut and screw 58 and 60 are disposed through the proximate end of front slot 54A and front apertures 56A, 56B and 56C. The nut 58 and screw 60 are tightened so as to prevent movement of the heel arms 50A and 50B with respect to the front frame portion 13A, locking the front apertures 56A–56C at a longitudinal position 64A along the heel arms 50A and 50B. The "smallest" setting disposes the vamp sections 27 of the skate 10 forward into the toe box 14 further than any alternative skate 10 settings (discussed below). The vamp sections 27 are flexed towards each other, thereby decreasing the width of the skate 10. Support is provided to the user's foot by the wheels 30A–30D which are spaced approximately equal distances apart.

Figure 2:
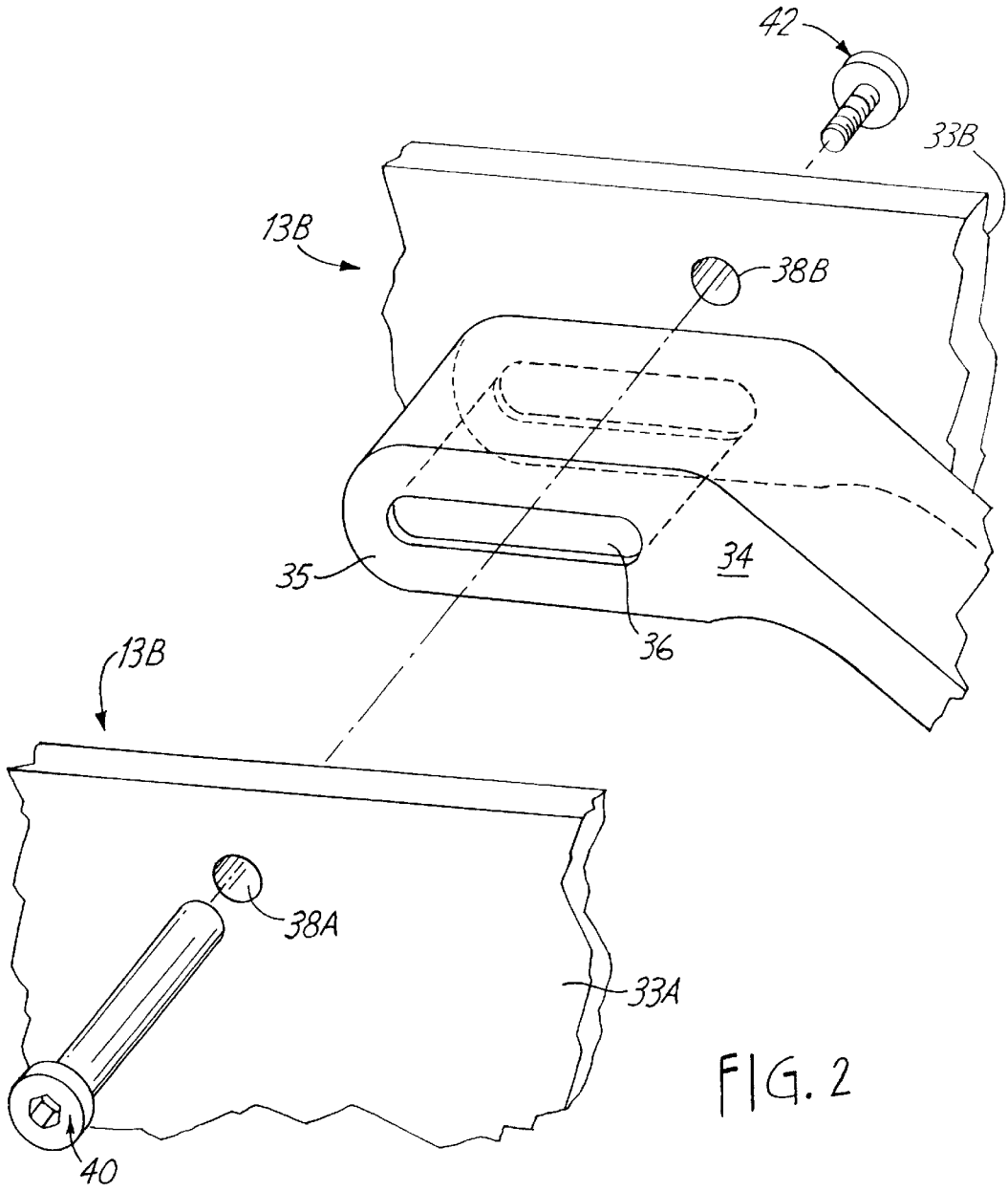
FIG. 2 is a partial exploded perspective view of the rear frame showing the expansion mechanism.

The skate 10 is positionable in a "small to intermediate" setting, as illustrated in FIG. 4B (in conjunction with FIGS. 2 and 3). The skate 10 is set so that it can accommodate a somewhat larger foot than in the "smallest" setting. For this setting, the toe box arm 34 is disposed slightly forward (with respect to the rear frame portion 13B) of the most rearward position (discussed above). The rear locking nut 40 and screw 42 are disposed through the rear slot 36 and rear apertures 38A and 38B and tightened so as to maintain the rear apertures 38A and 38B at a first distance 62B from the proximate end of the rear slot 36A. The heel arms 50A and 50B are disposed rearwardly (with respect to the front frame portion 13A) of the most forward position (discussed above). The front locking screw 60 and locking nut 58 are disposed through the front slots 54A and 54B and front apertures 56A–56C and tightened so as to maintain the front apertures 56A–56C at a second distance 64B from the proximate end of the front slots 54A and 54B. Thus, in comparison to the "smallest" setting, the front frame portion 13A is separated from the rear frame portion 13B a separation distance illustrated at 66B. The separation distance 66B is the combined distance of the first and second distances 62B and 64B. Distance 66B also illustrates the distance that the vamp sections 27 are withdrawn from the toe cap portion 23 of the boot frame 12.

In an "intermediate to large" setting, the skate 10 is set so that it can accommodate a somewhat larger foot than in the "small to intermediate" setting, but smaller than in the "largest" setting, discussed below. For this setting, best illustrated in FIG. 4C (in conjunction with FIGS. 2 and 3), the toe box arm 34 is disposed forward (with respect to the rear frame portion 13B) of the "small to intermediate" setting, but rearward of the "largest" setting. The rear locking nut 40 and screw 42 are disposed through the rear slot 36 and apertures 38A and 38B and tightened so as to maintain the rear apertures 38A and 38B at a first distance 62C from the proximate end of the rear slot 36. The heel arms 50A and 50B are disposed rearward (with respect to the front frame portion 13A) of the "small to intermediate" setting, but forward of the "largest" setting. The front locking screw 60 and locking nut 58 are disposed through the front slots 54A and 54B and front apertures 56A–56C and tightened so as to maintain the front apertures 56A–56C at a second distance 64C from the proximate end of the front slots 54A and 54B. Thus, the front frame portion 13A is separated from the rear frame portion 13B a distance illustrated at 66C, which is the collective distance of the first and second distances 62C and 64C. The distance 66C also illustrates the distance that the vamp sections 27 are withdrawn from the toe cap portion 23 of the boot frame 12. The distance 66C is greater than the distance 66B described with respect to the "small to intermediate setting" above.

Figure 4D:
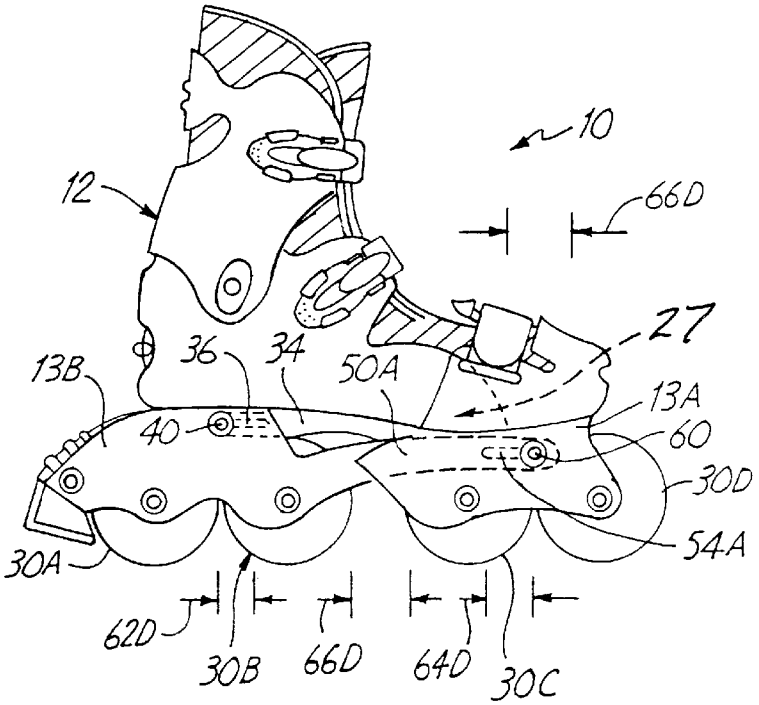
Figure 4C:
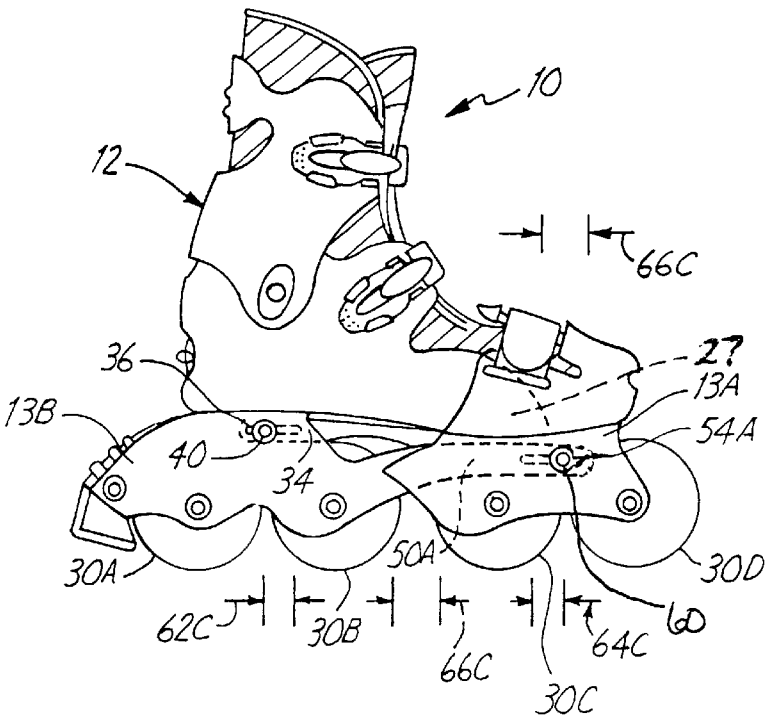

In the extreme expanded "largest" setting of the skate 10, best illustrated in FIG. 4D (in conjunction with FIGS. 2 and 3), the skate 10 cannot be expanded any further. The toe box arm 34 is disposed in a most forward position (with respect to the rear frame portion 13B) allowed by the rear locking nut and screw 40 and 42 interfacing with the rear slot 36. The rear locking nut 40 and rear locking screw 42 are disposed through the distal end of rear slot 36 in the same manner described above. The nut 40 and screw 42 are tightened so as to prevent movement of the toe box arm 34 with respect to the rear frame portion 13B. Rear nut 40 and rear screw 42 are tightened at a distance 62D from the proximate end of the rear slot 36. Thus, the distance 62D is preferably approximately the same distance as the length of the rear slot 36. Similarly, heel arms 50A and 50B are disposed in a most rearward position (with respect to the front frame portion 13A) allowed by the front locking nut and screw 58 and 60 interfacing with the front slots 54A and 54B. The front locking nut and screw 58 and 60 are disposed through the distal end of front slots 54A and 54B in the same manner described above. Front nut and screw 58 and 60 are tightened at a distance 64D from the proximate end of the front slots 54A and 54B, the distance 64D is preferably approximately the same distance as the length of the front slots 54A and 54B. The separation of the front frame portion 13A from the rear frame portion 13B is illustrated by separation distance 66D. The separation distance 66D also illustrates the maximum distance that the vamp sections 27 can be withdrawn from the toe cap portion 23 of the boot frame 12. Distance 66D is the maximum amount that the skate 10 can be expanded, and is the cumulative distance of the front slot 54A (or 54B) and the rear slot 36. Although only four positions are illustrated and described, a person skilled in the art will realize that the user could expand the skate to any size between the fully expanded and fully contracted positions.

The parts of the user's foot that bear the user's weight, namely the toe and heel portions, are supported by the wheels 30A–30D. Thus, as the skate 10 is expanded to accommodate a larger foot, the wheel holder frame 13 is expanded so that the unsupported portion of the boot 12 occurs under the middle (or instep) portion of the boot, illustrated by the separation distance 66B–66D. The toe box 14 positions the toe portion of the foot directly over the front frame portion 13A of the wheel holder frame 13, and the heel portion of the foot is positioned directly over the rear frame portion 13B of the wheel holder frame 13. The balance of wheel distribution over the front and rear frame portions 13A and 13B gives the user the same high level of stability, regardless of the setting at which the skate 10 is positioned.

Additionally, the arms 34, 50A and 50B which provide adjusting and locking means along the sides of the skate 33A and 33B do not interfere with or alter the boot shape. Thus, the inventive expansion system provides a high performance skate which fits the user's foot so as to provide comfort and balance, while still allowing for adjustment to fit various foot sizes.

A person skilled in the art will realize that although the invention is described as having four wheels, an alternate number of wheels may be provided as long as they are balanced equally between the front and rear frame sections 13A and 13B.

Figure 5:
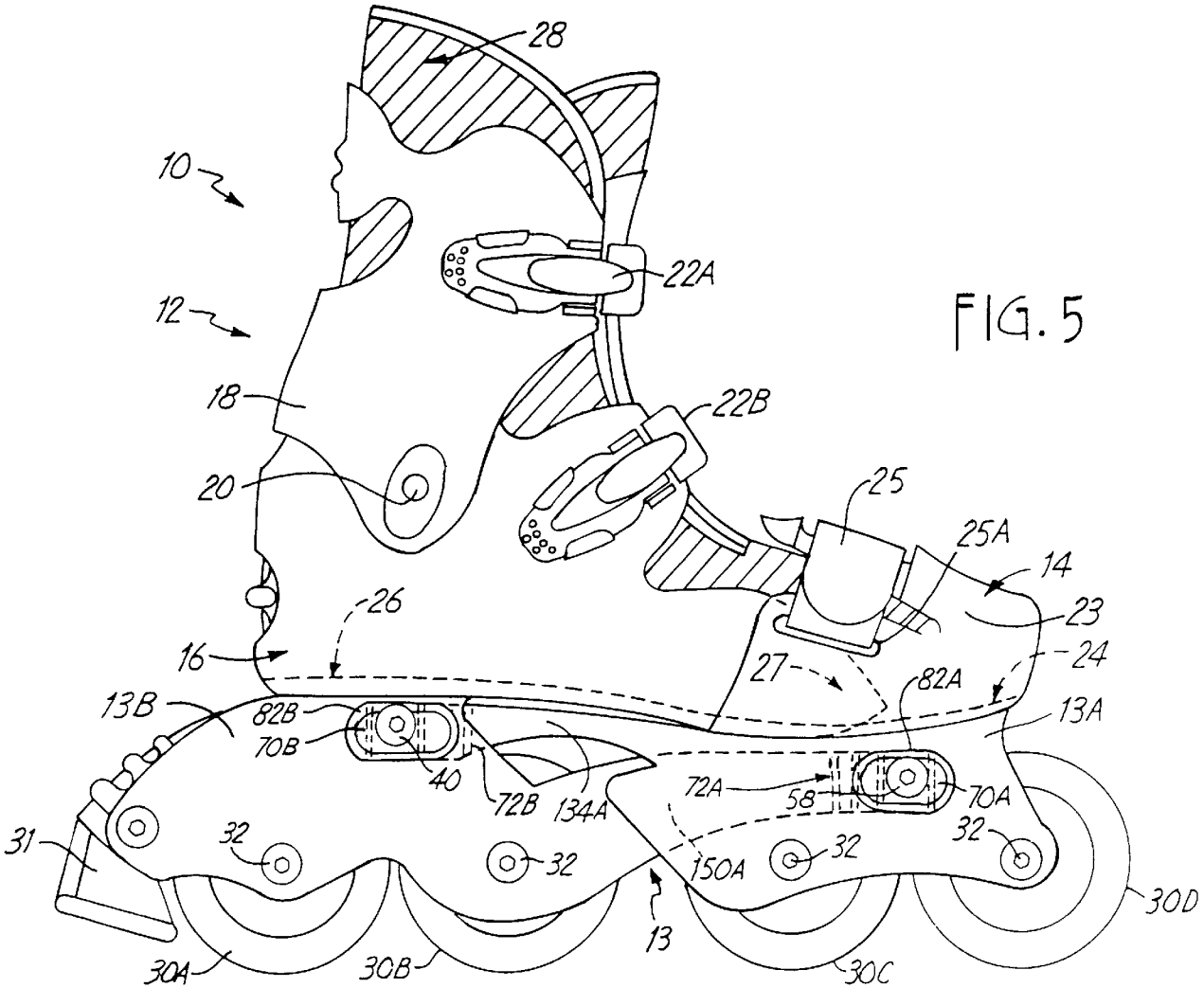
FIG. 5 is a side view of the inventive in-line skate using adjustable lock spacers.
Figure 6:
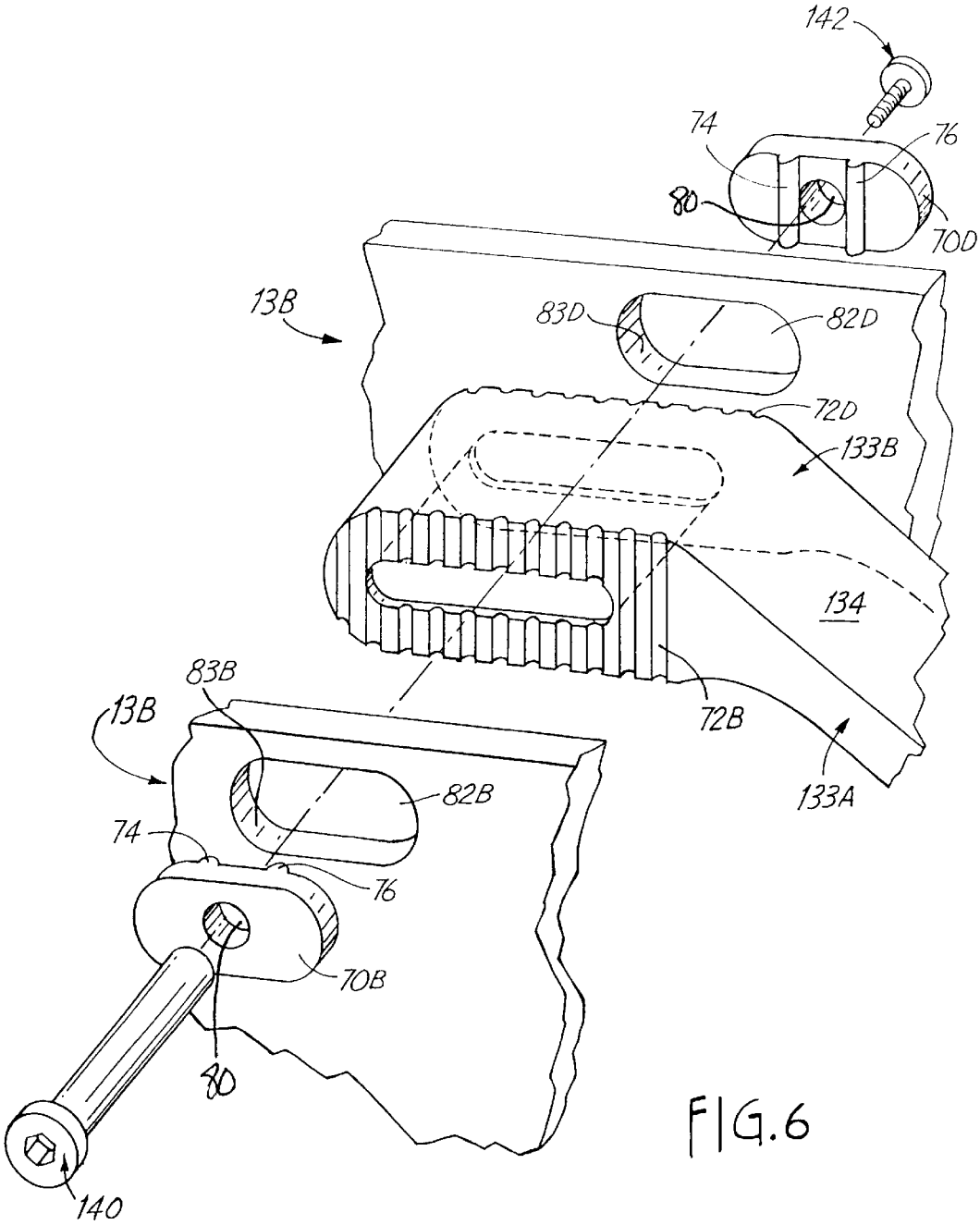
FIG. 6 is a partial exploded perspective view of the rear frame illustrated in FIG. 5.
Figure 7:
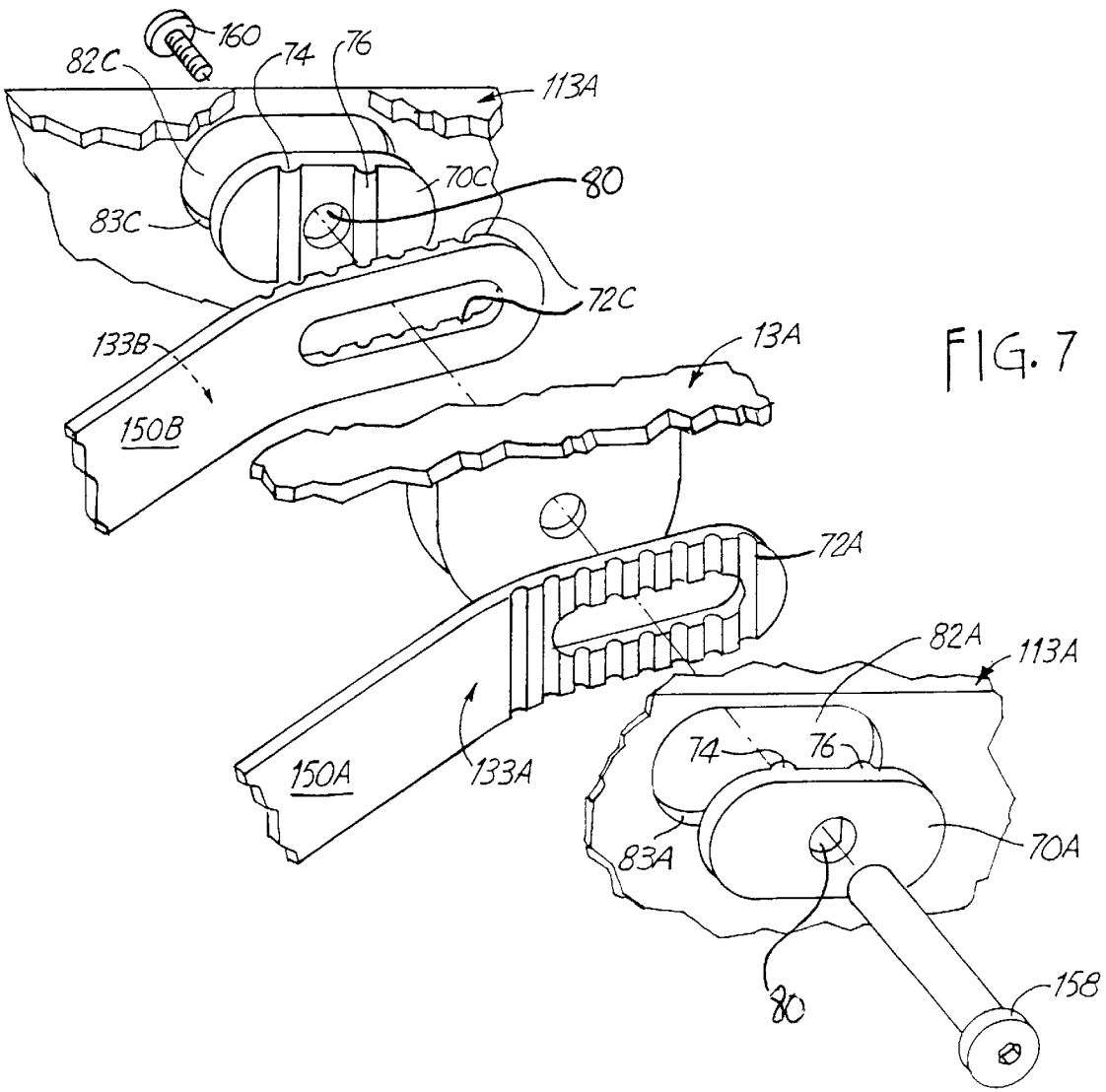
FIG. 7 is a partial exploded perspective view of the front frame illustrated in FIG. 5.

A second preferred embodiment of the inventive skate 10 uses adjustable lock spacers 70A–70D to connect the front frame portion 13A to the rear frame portion 13B as illustrated in FIGS. 5–7. A plurality of indentations 72A–72D are disposed into an instep side 133A and outer side 133B of a toe box arm 134 and into an instep side 133A of heel arm 150A and an outer side 133B of heel arm 150B.

First and second detents 74 and 76 extend from the adjustable lock spacers 70A–70D. A bore 80 is disposed through the spacers 70A–70D between the first and second detents 74 and 76. The first and second detents 74 and 76 cooperatively engage one of the plurality of indentations 72A–72D (respectively) to vary the skate 10 size. A person skilled in the art would realize that the locations of the detents and indentations may be reversed so that the indentations are located on the spacer 70A–70D, and the detents on the arms 134, 15A and 15B. Openings 82A–82D are disposed through the instep side 133A and outer side 133B of front frame portion 13A and rear frame portion 13B. The openings 82A–82D are shaped to substantially conform to the shape of the spacers 70A–70D. The spacers 70A–70D are disposed in the openings 82A–82D so that the spacers 70A–70D can engage the arms 134, 150A and 150B. The spacers 70A–70D are prevented from falling out of the openings 82A–82D by an internal wall 83A–83D in each opening 82A–82D and by screws and nuts 140, 142, 158 and 160 which clamp the spacers 70A–70D against the arms 134, 150A and 150B.

The screws and nuts 140, 142, 158 and 160 are disposed through the bore 80 in each spacer 70A–70D, and transversely through the skate 10 as described with respect to FIGS. 2 and 3. The nuts 140 and 158 are tightened onto the screws 42 and 60 which force the detents 74 and 76 of each spacer 70A–70D against the indentations 72A–72D of the arms 134, 150A and 150B. Thus, the detents 74 and 76 are secured within the selected indentations 72A–72D. The use of the indentations and detents securely locks the arms 34A, 34B, 52A and 52B in place with respect to the front and rear frame 13A and 13B, as opposed to the frictional method described previously. Each indentation 72A–72D is typically approximately four millimeters apart from the adjacent indentation on each outside face 73A–73D and the detents on each lock spacer 70A–70D is typically approximately eight millimeters apart. Thus, the arms may be moved in four millimeter increments with respect to the front and rear frame 13A and 13B. Using the spacers 70A–70D ensures that the arms 134A, 134B, 150A stay fixed in place with respect to the front and rear frame 13A and 13B.

Although the present invention has been described with reference to preferred embodiments, workers skilled in the art will recognize that changes may be made in form and detail without departing from the spirit and scope of the invention.

What is claimed is:

1. A skate comprising:

a toe box portion;

a front frame portion fixedly connected to the toe box portion, the front frame portion including a substantially vertical instep side member and a substantially vertical outer side member, wherein the front frame portion is adapted to hold at least one ground engaging wheel;

a heel portion;

a rear frame portion fixedly connected to the heel portion, the rear frame portion including a substantially vertical instep side member and a substantially vertical outer side member, wherein the rear frame portion is adapted to hold at least one ground engaging wheel;

wherein the rear frame portion includes a forwardly extending arm that slideably engages the front frame portion and extends between and is engaged with the front frame portion's instep side member and the front frame portion's outer side member, and the front frame portion includes a rearwardly extending arm that slideably engages the rear frame portion and extends between and is engaged with the rear frame portion's instep side member and the rear frame portion's outer side member; and wherein the frame portions are slidable towards or away from each other thereby allowing the distance between the toe box portion and heel portion and the length of the frame to be simultaneously adjusted in relation to the length of a user's foot.

2. The skate of claim 1, wherein the forwardly extending arm includes a front slot;

wherein the front frame portion includes a front aperture disposed through the front frame portion; and wherein the front aperture overlies the front slot.

3. The skate of claim 2, wherein the rearwardly extending arm includes a rear slot;

wherein the rear frame portion includes a rear aperture disposed into the rear frame portion; and wherein the rear aperture overlies the rear slot.

4. The skate of claim 3 further including:

a front pin extending through the front slot and the front aperture, wherein the front pin serves to maintain the position of the forwardly extending arm with respect to the front frame portion.

5. The skate of claim 4 further including:

a rear pin extending through the rear slot and the rear aperture, wherein the rear pin serves to maintain the position of the rearwardly extending arm with respect to the rear frame portion.

6. The skate of claim 5, wherein the heel portion includes forwardly extending vamp sections which extend into the toe box portion such that the vamp sections are flexed inwardly or outwardly to adjust the width of the skate as the toe box portion and the heel portion are slid together or apart to adjust the length of the skate.

7. The skate of claim 1, wherein a plurality of ground engaging wheels are attached to the front frame portion and a plurality of wheels are attached to the rear frame portion, which proportionately re-distribute support along the skate when the heel portion is adjusted relative to the toe box portion.

8. The skate of claim 1, wherein the forwardly extending arm includes a first and a second forwardly extending arm; and wherein the first forwardly extending arm engages the instep side member of the front frame portion and the second forwardly extending arm engages the outer side member of the front frame portion.

9. The skate of claim 8, wherein the first forwardly extending arm includes a first front slot and the second forwardly extending arm includes a second front slot;

wherein the front frame portion includes at least one front aperture extending through the instep side member and the outer side member and wherein the front aperture on the instep side member overlies the first front slot and the front aperture on the outer side member overlies the second front slot.

10. The skate of claim 9, wherein the first rearwardly extending arm includes a first rear slot;

wherein the rear frame portion includes at least one rear aperture extending through the instep side member and the outer side member wherein the rear aperture overlies the first rear slot.

11. The skate of claim 10 further including:

a front pin extending through the first front slot, the front aperture, and the second front slot, wherein the front pin serves to maintain the position of the first and second forwardly extending arms with respect to the front frame portion.

12. The skate of claim 11 further including:

a rear pin extending through the rear slot and the rear aperture, wherein the rear pin serves to maintain the position of the first rearwardly extending arm with respect to the rear frame portion.

13. The skate of claim 12, wherein the front pin includes a front screw section and a front nut section, and the rear pin includes a rear screw section and a rear nut section.

14. The skate of claim 13, wherein the heel portion includes a forwardly extending vamp sections which extend into the toe box portion such that the vamp sections are flexed inwardly or outwardly to adjust the width of the skate as the toe box portion and the heel portion are slid together or apart to adjust the length of the skate.

15. The skate of claim 14, wherein the front frame portion is adapted to hold a plurality of ground engaging wheels; and wherein the rear frame portion is adapted to hold a plurality of ground engaging wheels.

16. The skate of claim 15, wherein a plurality of ground engaging wheels are attached to the front frame portion and a plurality of wheels are attached to the rear frame portion, proportionately re-distribute support along the skate when the heel portion is adjusted relative to the toe box portion.

17. A skate comprising:

a boot having a toe box portion and a heel portion;

a front frame portion fixedly connected to the toe box portion, the front frame portion including a substantially vertical instep side member and a substantially vertical outer side member, wherein the front frame portion is adapted to hold at least two tandemly disposed front ground engaging wheels;

a rear frame portion fixedly connected to the heel portion, the rear frame portion including a substantially vertical instep side member and a substantially vertical outer side member, wherein the rear frame portion is adapted to hold at least two tandemly disposed rear ground engaging wheels;

wherein the rear frame portion includes a forwardly extending arm that slideably engages the front frame portion and extends between and is engaged with the front frame portion's instep side member and the front frame portion's outer side member, and the front frame portion includes a rearwardly extending arm that slideably engages the rear frame portion and extends between and is engaged with the rear frame portion's instep side member and the rear frame portion's outer side member; and wherein the toe box portion with the front frame portion and the heel portion with the rear frame portion are slidable towards or away from each other to adjust the length of the boot and the front and rear ground engaging wheels.

* * * * *